US010720733B2

(12) United States Patent
Su et al.

(10) Patent No.: US 10,720,733 B2
(45) Date of Patent: Jul. 21, 2020

(54) ELECTRICAL CONNECTOR TERMINAL ASSEMBLY WITH TERMINALS HAVING A VERY SPECIFIC PROFILE

(71) Applicant: Cheng Uei Precision Industry Co., Ltd., New Taipei (TW)

(72) Inventors: Yu-Hung Su, New Taipei (TW); Jyun Liao, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 16/407,097

(22) Filed: May 8, 2019

(65) Prior Publication Data

US 2020/0014151 A1 Jan. 9, 2020

(30) Foreign Application Priority Data

Jul. 6, 2018 (TW) ..... 107209199 U

(51) Int. Cl.

| | |
|---|---|
| ***H01R 12/72*** | (2011.01) |
| ***H01R 13/6585*** | (2011.01) |
| ***H01R 13/629*** | (2006.01) |
| ***H01R 12/70*** | (2011.01) |
| ***H01R 12/71*** | (2011.01) |
| ***H01R 12/57*** | (2011.01) |
| ***H01R 13/502*** | (2006.01) |
| *H01R 107/00* | (2006.01) |

(52) U.S. Cl.

CPC ..... *H01R 13/6585* (2013.01); *H01R 12/57* (2013.01); *H01R 12/707* (2013.01); *H01R 12/716* (2013.01); *H01R 12/724* (2013.01); *H01R 13/502* (2013.01); *H01R 13/629* (2013.01); *H01R 2107/00* (2013.01)

(58) Field of Classification Search

CPC ..... H01R 24/60; H01R 12/50; H01R 12/55; H01R 12/724; H01R 13/02

See application file for complete search history.

(56) References Cited

U.S. PATENT DOCUMENTS

| | | | | |
|---|---|---|---|---|
| 9,478,884 | B2 * | 10/2016 | Tsai | H01R 12/724 |
| 9,685,747 | B2 * | 6/2017 | Chen | H01R 24/70 |
| 10,348,028 | B2 * | 7/2019 | Hayashi | H01R 13/436 |

* cited by examiner

*Primary Examiner* — Vanessa Girardi

(74) *Attorney, Agent, or Firm* — Cheng-Ju Chiang

(57) ABSTRACT

An electrical connector includes an insulating body, a conductive terminal assembly, a connection terminal assembly and an outer shell. A middle portion of a front surface of the insulating body is recessed rearward to form an insertion slot. A middle portion of a rear surface of the insulating body is recessed forward to form a receiving groove. The conductive terminal assembly is assembled to the insulating body. The conductive terminal assembly includes a plurality of conductive terminals, and a first base body fastened to the plurality of the conductive terminals. The connection terminal assembly is assembled to the insulating body. The connection terminal assembly includes a plurality of connection terminals, and a second base body fastened to the plurality of the connection terminals. The outer shell surrounds the insulating body.

20 Claims, 12 Drawing Sheets

ELECTRICAL CONNECTOR TERMINAL ASSEMBLY WITH TERMINALS HAVING A VERY SPECIFIC PROFILE

CROSS-REFERENCE TO RELATED APPLICATION

The present application is based on, and claims priority from, Taiwan Patent Application No. 107209199, filed Jul. 6, 2018, the disclosure of which is hereby incorporated by reference herein in its entirety.

BACKGROUND OF THE INVENTION

1. Field of the Invention

The present invention generally relates to an electrical connector and a terminal assembly thereof, and more particularly to an electrical connector and a terminal assembly thereof reaching a high-frequency transmission effect.

2. The Related Art

With network and communication demands being increased day by day, transmission speed requirements of data communications and data storages among devices are continuously improved. In order to meet needs of different equipment, a structure and a thickness of an insulating body or a terminal assembly which includes a plurality of terminals in a conventional electrical connector need be adjusted accordingly.

The thickness of each terminal in the conventional electrical connector is usually between 0.12 mm and 0.15 mm. Because an impedance of the electrical connector will be changed according to the thickness of a material of each terminal, and the plurality of the terminals arranged transversely will affect a mutual impedance between each two terminals, in order to adjust the thickness of each terminal to 0.25 mm, shapes and structures of the insulating body and the plurality of the terminals need be redesigned for achieving a high-frequency transmission effect, so that the conventional electrical connector is still capable of having the high-frequency transmission effect under a condition of the thickness of each terminal being increased.

Therefore, it is essential to provide a new-typed electrical connector and a terminal assembly thereof, so that when the terminal assembly is under a condition of a thickness of a terminal of the terminal assembly being increased, the new-typed electrical connector and the terminal assembly reach a high-frequency transmission effect.

SUMMARY OF THE INVENTION

An object of the present invention is to provide an electrical connector. The electrical connector includes an insulating body, a conductive terminal assembly, a connection terminal assembly and an outer shell. A middle portion of a front surface of the insulating body is recessed rearward to form an insertion slot. A middle portion of a rear surface of the insulating body is recessed forward to form a receiving groove penetrating downward through a bottom surface of the insulating body. A front of the receiving groove is divided into a rear conductive terminal slot and a rear connection terminal slot along an up-down direction. The insulating body opens a plurality of front conductive terminal slots penetrating through a front surface, a bottom surface and a rear surface of a top wall of the insertion slot, and a plurality of front connection terminal slots penetrating through a front surface, an upper surface and a rear surface of a bottom wall of the insertion slot. The rear conductive terminal slot is communicated among the plurality of the front conductive terminal slots, the insertion slot and a rear of the receiving groove, and the rear connection terminal slot is communicated among the plurality of the front connection terminal slots, the insertion slot and the rear of the receiving groove. The conductive terminal assembly is assembled to the insulating body. The conductive terminal assembly includes a plurality of conductive terminals, and a first base body fastened to the plurality of the conductive terminals. The first base body has a plurality of openings. The first base body has a first base portion. A rear end of the first base portion protrudes downward to form a base board. The first base body has a plurality of conductive terminal grooves transversely arranged in a row. The plurality of the conductive terminals are fixed in the plurality of the conductive terminal grooves, respectively. Each conductive terminal has a first fixing portion. A front end of the first fixing portion extends frontward to form a first extending portion. Two sides of a rear end of the first extending portion are recessed inward. The rear end of the first extending portion is defined as a first material reducing portion connected to the first fixing portion, so a width of the first material reducing portion is smaller than widths of the first fixing portion and the first extending portion. Two sides of a front end of the first extending portion are gradually shrunk inward, and the front end of the first extending portion is defined as a first material shrinking portion. A front end of the material shrinking portion extends frontward and then is arched downward to form a first contact portion. A front end of the first contact portion is bent upward and then extends frontward to form a buckling portion. A rear end of the first fixing portion extends downward to form a vertical portion. A width of a lower portion of the first vertical portion is smaller than widths of the first fixing portion and an upper portion of the first vertical portion. A bottom end of the first vertical portion is bent rearward to form a first soldering portion. A width of the first soldering portion is smaller than a width of the first vertical portion. The buckling portions, the first contact portions and front ends of the first extending portions of the plurality of the conductive terminals are assembled to the plurality of the front conductive terminal slots. Rear ends of the first extending portions and the first fixing portions of the plurality of the conductive terminals together with the first base portion are assembled to the rear conductive terminal slot. The first fixing portions, the first material reducing portions and the first vertical portions of the plurality of the conductive terminals are exposed to the plurality of the openings. The first vertical portions of the plurality of the conductive terminals and the base board are received in the rear of the receiving groove. The first soldering portions of the plurality of the conductive terminals are exposed out of the insulating body. The connection terminal assembly is assembled to the insulating body. The connection terminal assembly includes a plurality of connection terminals, and a second base body fastened to the plurality of the connection terminals. The second base body has a second base portion. A rear portion of a bottom surface of the second base portion extends downward to form an embedding block. The second base body has a plurality of connection terminal grooves. The plurality of the connection terminals are fixed in the plurality of the connection terminal grooves, respectively. Each connection terminal has a second fixing portion. A front end of the second fixing portion extends frontward to form a second extending portion. A rear end of the second fixing portion extends downward to form a second vertical portion. Front ends of the second extending portions of the plurality of the connection terminals are assembled to the plurality of the front connection terminal slots. The second fixing portions and rear ends of the second extending portions of the plurality of the connection terminals together with the second base portion are assembled to the rear connection terminal slot. Upper portions of the second vertical portions of the plurality of the connection terminals and the embedding block are received in the rear of the receiving groove and located in front of the base board. The outer shell surrounds the insulating body. A middle of the outer shell has an accommodating space penetrating through a front of the outer shell. The insulating body is accommodated in the accommodating space. A rear of a bottom of the outer shell opens an accommodating groove connected with a rear of a bottom of the accommodating space. The rear of the receiving groove is corresponding to the accommodating groove.

Another object of the present invention is to provide a terminal assembly of an electrical connector. The terminal assembly includes a plurality of conductive terminals, and a base body integrally molded to the plurality of the conductive terminals. Each conductive terminal has a first fixing portion. A front end of the first fixing portion extends frontward to form a first extending portion. Two sides of a rear end of the first extending portion are recessed inward. The rear end of the first extending portion is defined as a first material reducing portion connected to the first fixing portion, so a width of the first material reducing portion is smaller than widths of the first fixing portion and the first extending portion. Two sides of a front end of the first extending portion are gradually shrunk inward to show a trapezoid shape along a front-to-rear direction, and the front end of the first extending portion is defined as a first material shrinking portion. A front end of the first material shrinking portion extends frontward and then is arched downward to form a first contact portion. A front end of the first contact portion is bent upward and then extends frontward to form a buckling portion. A rear end of the first fixing portion extends downward to form a first vertical portion, a width of a lower portion of the first vertical portion is smaller than widths of the first fixing portion and an upper portion of the first vertical portion. A bottom end of the first vertical portion is bent rearward to form a first soldering portion, a width of the first soldering portion is smaller than a width of the first vertical portion. The base body has a first base portion disposed horizontally. A rear end of the base portion protrudes downward to form a base board. The base body has a plurality of conductive terminal grooves transversely arranged in a row. The row of the conductive terminal grooves penetrates through a front surface of the first base portion and a bottom surface of the base board. The plurality of the conductive terminals are fixed in the plurality of the conductive terminal grooves, respectively. The first base body has a plurality of openings communicated with the plurality of the conductive terminal grooves. The first fixing portions, the first material reducing portions and the first vertical portions of the plurality of the conductive terminals are exposed to the plurality of the openings. The first soldering portions of the plurality of the conductive terminals are exposed out of the insulating body.

Another object of the present invention is to provide a terminal assembly of an electrical connector. The terminal assembly includes a plurality of connection terminals, and a second base body integrally molded to the plurality of the connection terminals. Each connection terminal has a second fixing portion. A front end of the second fixing portion extends frontward to form a second extending portion. Two sides of a front end of the second extending portion are gradually shrunk inward to show a trapezoid shape along a front-to-rear direction, and the front end of the second extending portion is defined as a second material shrinking portion. A front end of the second material shrinking portion is arched upward to form a second contact portion. A front end of the second contact portion extends frontward to form a blocking portion. A rear end of the second fixing portion extends downward to form a second vertical portion. Two opposite sides of a lower portion of the second vertical portion are recessed inward. The lower portion of the second vertical portion is defined as a second material reducing portion, and a width of the second material reducing portion of the second vertical portion is smaller than a width of the second fixing portion. The second base body has a second base portion. A rear portion of a bottom surface of the second base portion extends downward to form an embedding block. The second base body has a plurality of connection terminal grooves. The plurality of the connection terminal grooves are of L shapes. Mouths of the plurality of the L-shaped connection terminal grooves face downward. The plurality of the connection terminal grooves penetrate through a front surface of the second base portion and a bottom surface of the embedding block. The second base body has a plurality of exposing holes communicated with the plurality of the connection terminal grooves. The plurality of the connection terminals are fixed in the plurality of the connection terminal grooves, respectively. The second fixing portions of the plurality of the connection terminals are disposed corresponding to and exposed to the plurality of the exposing holes.

As described above, the first material reducing portions, the first material shrinking portions and the lower portions of the first vertical portions of the plurality of the conductive terminals are disposed in the electrical connector, top surfaces of the first material reducing portions of the plurality of the conductive terminals are exposed upward in a plurality of fifth openings of the first base body, respectively, bottom surfaces of the first material reducing portions and the first fixing portions of the plurality of the conductive terminals are exposed downward to a first opening, so positions and dimensions of the plurality of the conductive terminals reach a best design in the conductive terminal assembly, and the upper portions of the first vertical portions of the plurality of the conductive terminals are exposed to a plurality of third openings, so the electrical connector and the conductive terminal assembly achieve a high-frequency transmission effect. Furthermore, when the second base body is molded, the second base portion has a plurality of second exposing holes arranged transversely to limit the plurality of the connection terminals in a mold, so the connection terminal assembly has a better dimension accuracy. In addition, the plurality of the connection terminals are connected with a first material pulling element, and the plurality of the conductive terminals are connected with a second material pulling element to reach conditions of manufacturing the electrical connector.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
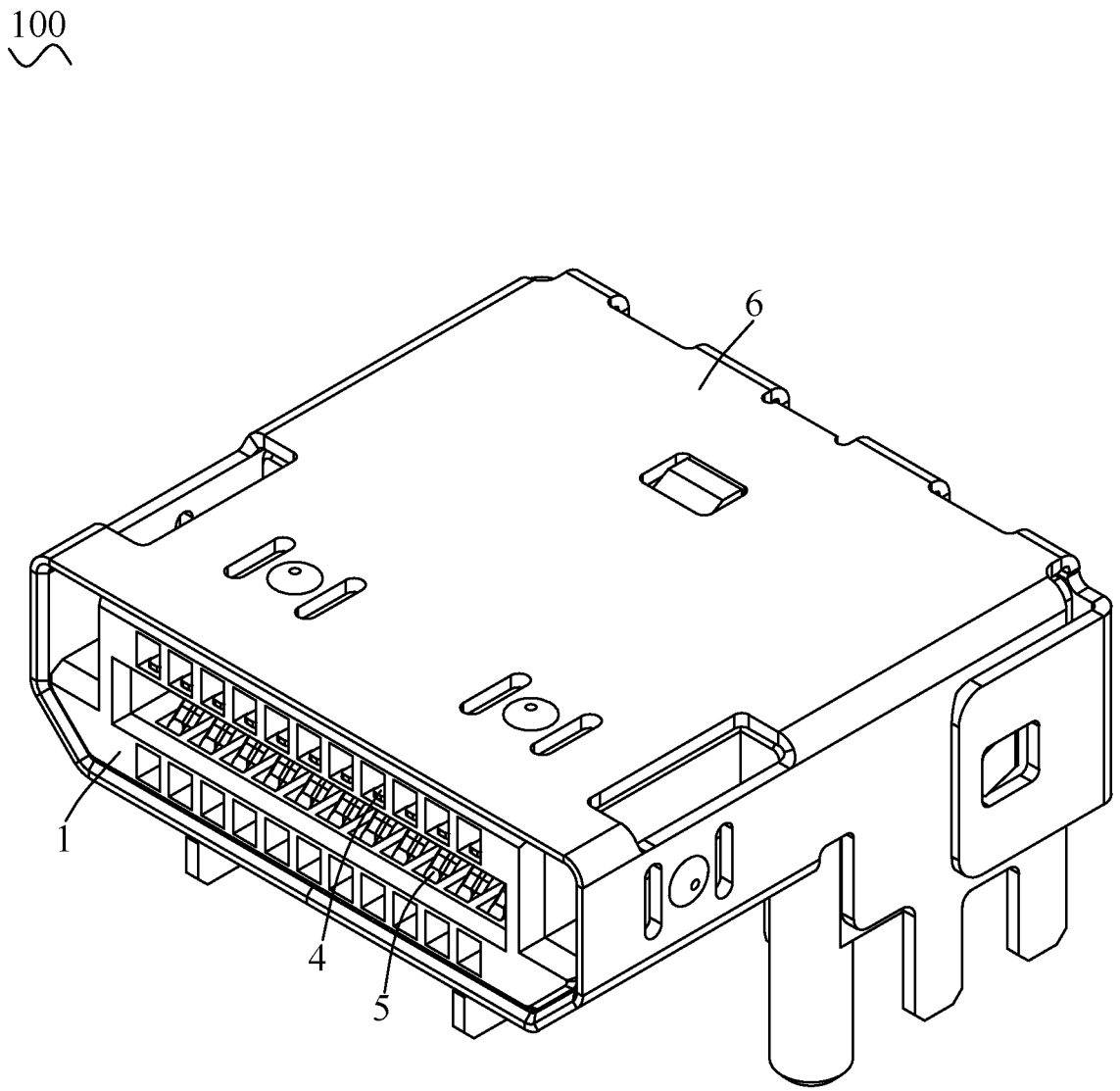
FIG. 1 is a perspective view of an electrical connector in accordance with the present invention.
Figure 2:
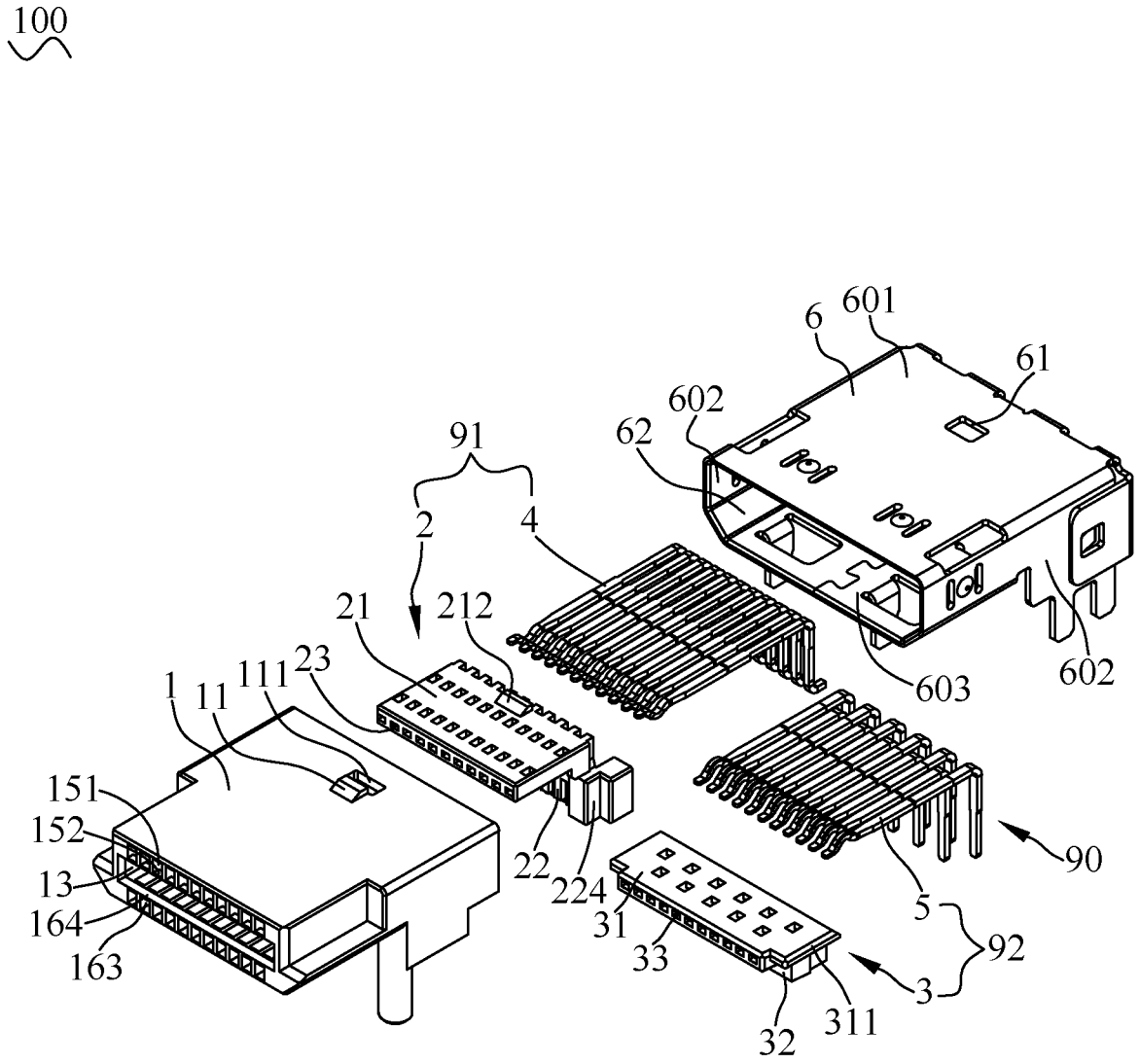
FIG. 2 is an exploded perspective view of the electrical connector in accordance with the present invention.

With reference to FIG. 1 and FIG. 2, an electrical connector 100 in accordance with the present invention is shown. The electrical connector 100 is a high-frequency electrical connector. The electrical connector 100 includes an insulating body 1, a terminal assembly 90 and an outer shell 6. The terminal assembly 90 includes a conductive terminal assembly 91 and a connection terminal assembly 92.

Figure 3:
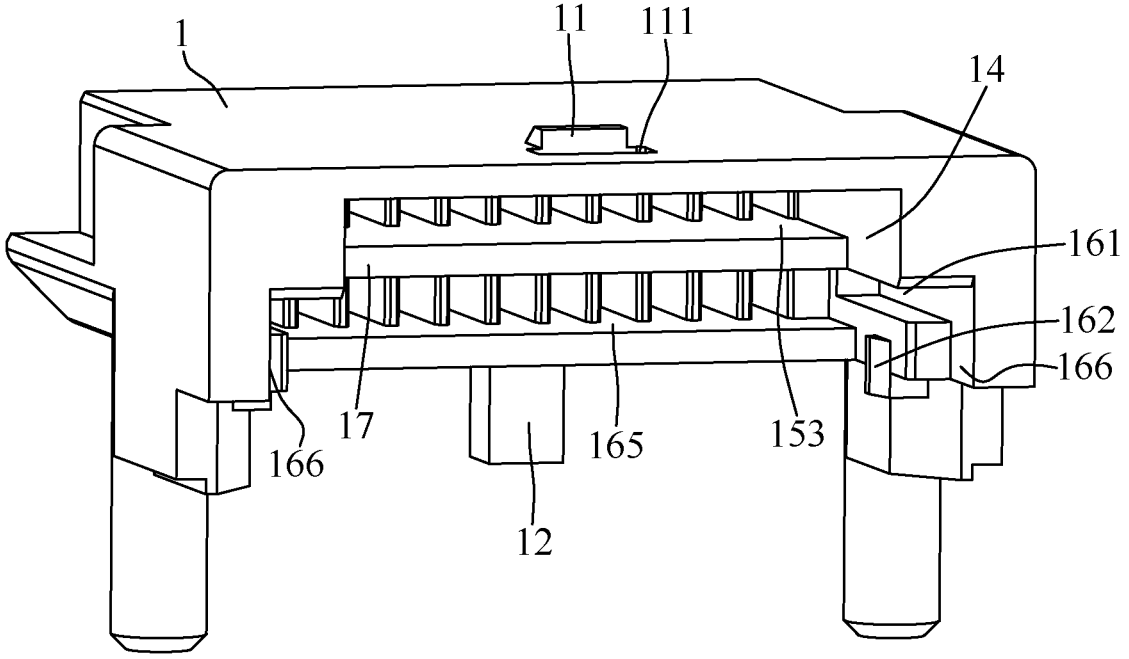
FIG. 3 is a perspective view of an insulating body of the electrical connector in accordance with the present invention.

With reference to FIG. 2 and FIG. 3, a middle of a rear of a top surface of the insulating body 1 protrudes upward to form a bump 11. The insulating body 1 opens a fastening groove 111 located at rear of the bump 11. A middle of a bottom surface of the insulating body 1 protrudes downward to form a limiting block 12. A middle portion of a front surface of the insulating body 1 is recessed rearward to form an insertion slot 13. A middle portion of a rear surface of the insulating body 1 is recessed forward to form a receiving groove 14 penetrating downward through the bottom surface of the insulating body 1. A front of the receiving groove 14 is divided into a rear conductive terminal slot 153 and a rear connection terminal slot 165 along an up-down direction. The rear conductive terminal slot 153 and the rear connection terminal slot 165 are isolated by a horizontally disposed partition board 17. The rear connection terminal slot 165 is located under the rear conductive terminal slot 153.

The insulating body 1 opens a plurality of front conductive terminal slots 151 penetrating through a front surface, a bottom surface and a rear surface of a top wall of the insertion slot 13, and a plurality of front connection terminal slots 163 penetrating through a front surface, an upper surface and a rear surface of a bottom wall of the insertion slot 13. The rear conductive terminal slot 153 is communicated among the plurality of the front conductive terminal slots 151, the insertion slot 13 and a rear of the receiving groove 14, and the rear connection terminal slot 165 is communicated among the plurality of the front connection terminal slots 163, the insertion slot 13 and the rear of the receiving groove 14. Bottoms of front ends of the plurality of the front conductive terminal slots 151 are communicated with the insertion slot 13. Rear ends of the plurality of the front conductive terminal slots 151 are connected with the rear conductive terminal slot 153. An upper limiting board 152 is disposed horizontally, and located between the front ends of the plurality of the front conductive terminal slots 151 and the insertion slot 13. The upper limiting board 152 is defined as bottom walls of the plurality of the front conductive terminal slots 151. Lower portions of two side walls of the receiving groove 14 are recessed oppositely to form two buckling slots 161. The rear connection terminal slot 165 is located between the two buckling slots 161. The lower portions of the two side walls of the receiving groove 14 protrude face to face to form two abutting blocks 162 located under the two buckling slots 161, respectively. Tops of front ends of the plurality of the front connection terminal slots 163 are communicated with the insertion slot 13. A lower limiting board 164 is disposed horizontally, and located between the front ends of the plurality of the front connection terminal slots 163 and the insertion slot 13. The lower limiting board 164 is defined as top walls of the plurality of the front connection terminal slots 163. Lower portions of two sides of the rear surface of the insulating body 1 are recessed frontward to form two locking grooves 166.

With reference to FIG. 2, FIG. 6, FIG. 7 and FIG. 12, the conductive terminal assembly 91 of the electrical connector 100 is assembled to the insulating body 1. The conductive terminal assembly 91 includes a plurality of conductive terminals 4, and a first base body 2 fastened to and integrally molded to the plurality of the conductive terminals 4, so the conductive terminal assembly 91 is integrally molded by the first base body 2 and the plurality of the conductive terminals 4. The plurality of the conductive terminals 4 are connected with a second material pulling element 82. The first base body 2 has a first base portion 21 disposed horizontally. A rear end of the first base portion 21 protrudes downward to form a base board 22. The first base body 2 has a plurality of conductive terminal grooves 23 transversely arranged in a row. The row of the conductive terminal grooves 23 penetrate through a front surface of the first base portion 21 and a bottom surface of the base board 22. A top surface of the first base portion 21 protrudes upward to form a convex block 212. A rear of a bottom surface of the first base portion 21 is recessed upward to bottoms of front ends of the plurality of the conductive terminal grooves 23 to form a first opening 213. A top wall of the first opening 213 has a plurality of second openings 214 penetrating through side walls of the plurality of the conductive terminal grooves 23 and extending to top walls of the plurality of the conductive terminal grooves 23.

The first base body 2 opens a plurality of third openings 221 arranged transversely. The plurality of the third openings 221 penetrate through a top end of a rear surface and a rear end of a top surface of the base board 22, and extend to tops of rear ends of the plurality of the conductive terminal grooves 23. The base board 22 opens a plurality of fourth openings 222 arranged transversely. The plurality of the fourth openings 222 penetrate a lower portion of a front surface and a front of a bottom surface of the base board 22, and extend rearward to fronts of lower portions of the plurality of the conductive terminal grooves 23. The first base portion 21 has a plurality of fifth openings 215 penetrating through the top surface of the first base portion 21 and communicating with tops of the front ends of the conductive terminal grooves 23. Several portions of the bottom surface of the base board 22 protrude downward to form a plurality of material adding portions 223, and the plurality of the material adding portions 223 are disposed corresponding to bottoms of the plurality of the conductive terminal grooves 23. Two sides of the base board 22 protrude outward to form two stopping blocks 224. So the first base body 2 has a plurality of openings 202 communicated with the plurality of the conductive terminal grooves 23. The plurality of the openings 202 include the first opening 213, the plurality of the second openings 214, the plurality of the third openings 221, the plurality of the fourth openings 222 and the plurality of the fifth openings 215.

Figure 4:
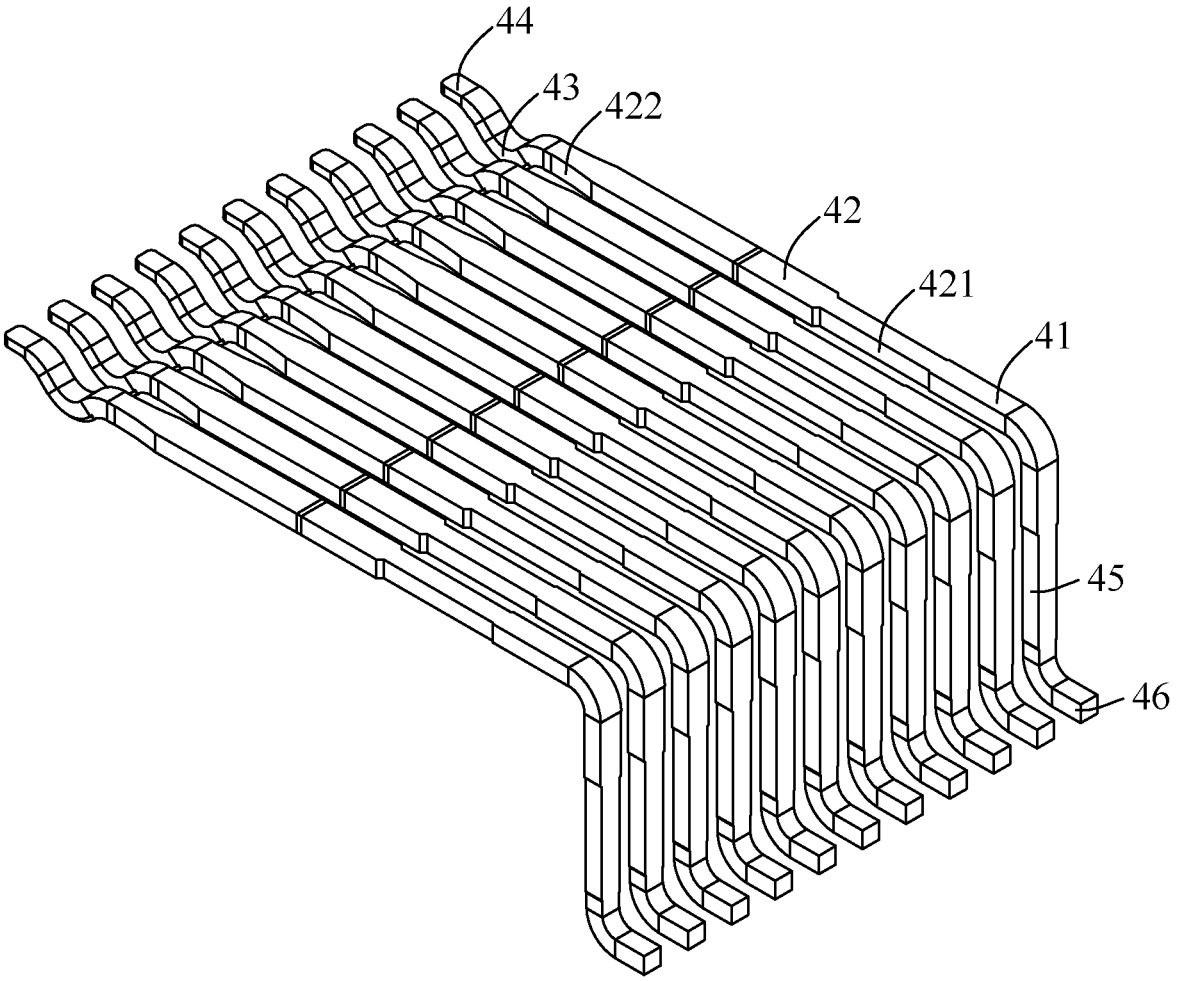
FIG. 4 is a perspective view of a plurality of conductive terminals of the electrical connector in accordance with the present invention.
Figure 6:
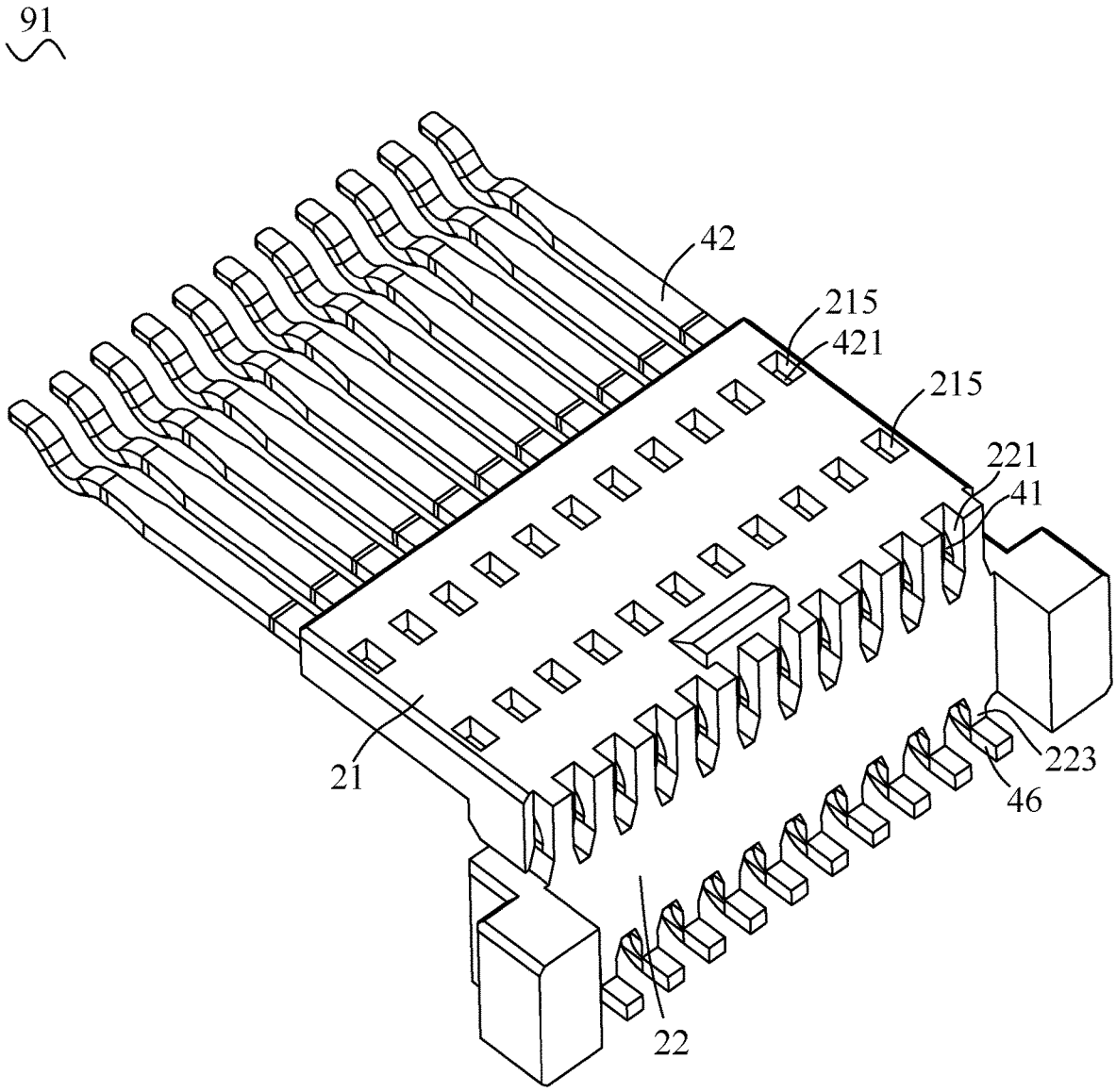
FIG. 6 is a perspective view of a conductive terminal assembly of the electrical connector in accordance with the present invention.
Figure 7:
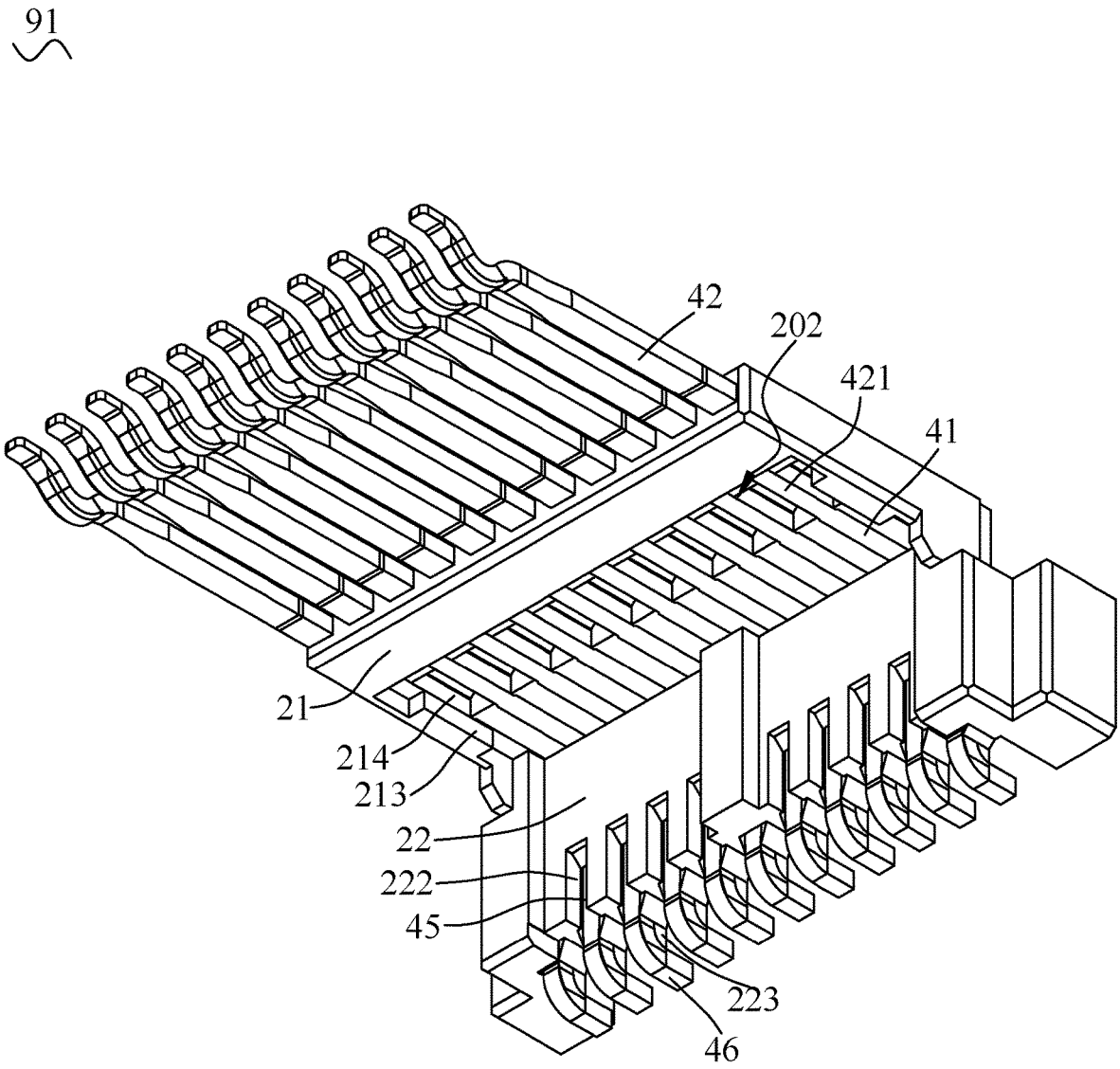
FIG. 7 is another perspective view of the conductive terminal assembly of the electrical connector of FIG. 6.

With reference to FIG. 4, FIG. 6 and FIG. 7, the plurality of the conductive terminals 4 are fixed in the plurality of the conductive terminal grooves 23, respectively. Front ends of the plurality of the conductive terminals 4 are assembled to the plurality of the front conductive terminal slots 151. Each conductive terminal 4 has a first fixing portion 41. A front end of the first fixing portion 41 extends frontward to form a first extending portion 42. Two sides of a rear end of the first extending portion 42 are recessed inward. The rear end of the first extending portion 42 is defined as a first material reducing portion 421 connected to the first fixing portion 41, so a width of the first material reducing portion 421 is smaller than widths of the first fixing portion 41 and the first extending portion 42. Two sides of a front end of the first extending portion 42 are gradually shrunk inward to show a trapezoid shape along a front-to-rear direction, and the front end of the first extending portion 42 is defined as a first material shrinking portion 422. A front end of the first material shrinking portion 422 extends frontward and then is arched downward to form a first contact portion 43. A front end of the first contact portion 43 is bent upward and then extends frontward to form a buckling portion 44. A rear end of the first fixing portion 41 extends downward to form a first vertical portion 45. A width of a lower portion of the first vertical portion 45 is smaller than widths of the first fixing portion 41 and an upper portion of the first vertical portion 45. A bottom end of the first vertical portion 45 is bent rearward to form a first soldering portion 46. A width of the first soldering portion 46 is smaller than a width of the first vertical portion 45. The first fixing portions 41, the first material reducing portions 421 and the first vertical portions 45 of the plurality of the conductive terminals 4 are exposed to the plurality of the openings 202.

With reference to FIG. 2, FIG. 8, FIG. 9 and FIG. 12, the connection terminal assembly 92 of the electrical connector 100 includes a plurality of connection terminals 5, and a second base body 3 fastened to and integrally molded to the plurality of the connection terminals 5. Tail ends of the plurality of the connection terminals 5 are connected with a first material pulling element 81. The plurality of the connection terminals 5 include a plurality of first connection terminals 501 and a plurality of second connection terminals 502. Each second connection terminal 502 is located between two of the plurality of the first connection terminals 501, so the plurality of the connection terminals 5 include an even number of the first connection terminals 501 and an odd number of the second connection terminals 502. The second base body 3 has a second base portion 31. A rear portion of a bottom surface of the second base portion 31 extends downward to form an embedding block 32. The second base body 3 has a plurality of connection terminal grooves 33. Fronts of the plurality of the connection terminal grooves 33 are transversely arranged in a row. Bottoms of the plurality of the connection terminal grooves 33 are arranged in two rows along the front-to-rear direction. The plurality of the connection terminal grooves 33 are of L shapes, mouths of the plurality of the L-shaped connection terminal grooves 33 face downward. The plurality of the connection terminal grooves 33 penetrate through a front surface of the second base portion 31 and a bottom surface of the embedding block 32. The second base body 3 has a plurality of exposing holes 301 communicated with the plurality of the connection terminal grooves 33. Two sides of the second base portion 31 protrude outward to form two buckling blocks 311. The second base portion 31 has a plurality of first exposing holes 312 arranged in two rows. Each row of the first exposing holes 312 are arranged transversely. The plurality of the first exposing holes 312 vertically penetrate upward through a top surface of the second base portion 31, and then extend downward and connect with the plurality of the connection terminal grooves 33, respectively.

The two rows of the first exposing holes 312 are arranged in a staggered arrangement and along the front-to-rear direction. The second base portion 31 has a plurality of second exposing holes 313 arranged transversely and disposed in front of the embedding block 32. The plurality of the second exposing holes 313 vertically penetrate downward through a bottom surface of the second base portion 31 and connect with the plurality of the connection terminal grooves 33, respectively. Fronts of two sides of the embedding block 32 protrude outward to form two fixing blocks 321, respectively. The embedding block 32 has a plurality of third exposing holes 322 penetrating downward through a bottom surface of the embedding block 32. The plurality of the third exposing holes 322 extend upward and connect with the plurality of the connection terminal grooves 33, respectively. The plurality of the third exposing holes 322 are interposed to areas among the plurality of the connection terminal grooves 33. The plurality of the exposing holes 301 include the plurality of the first exposing holes 312, the plurality of the second exposing holes 313 and the plurality of the third exposing holes 322.

Figure 5:
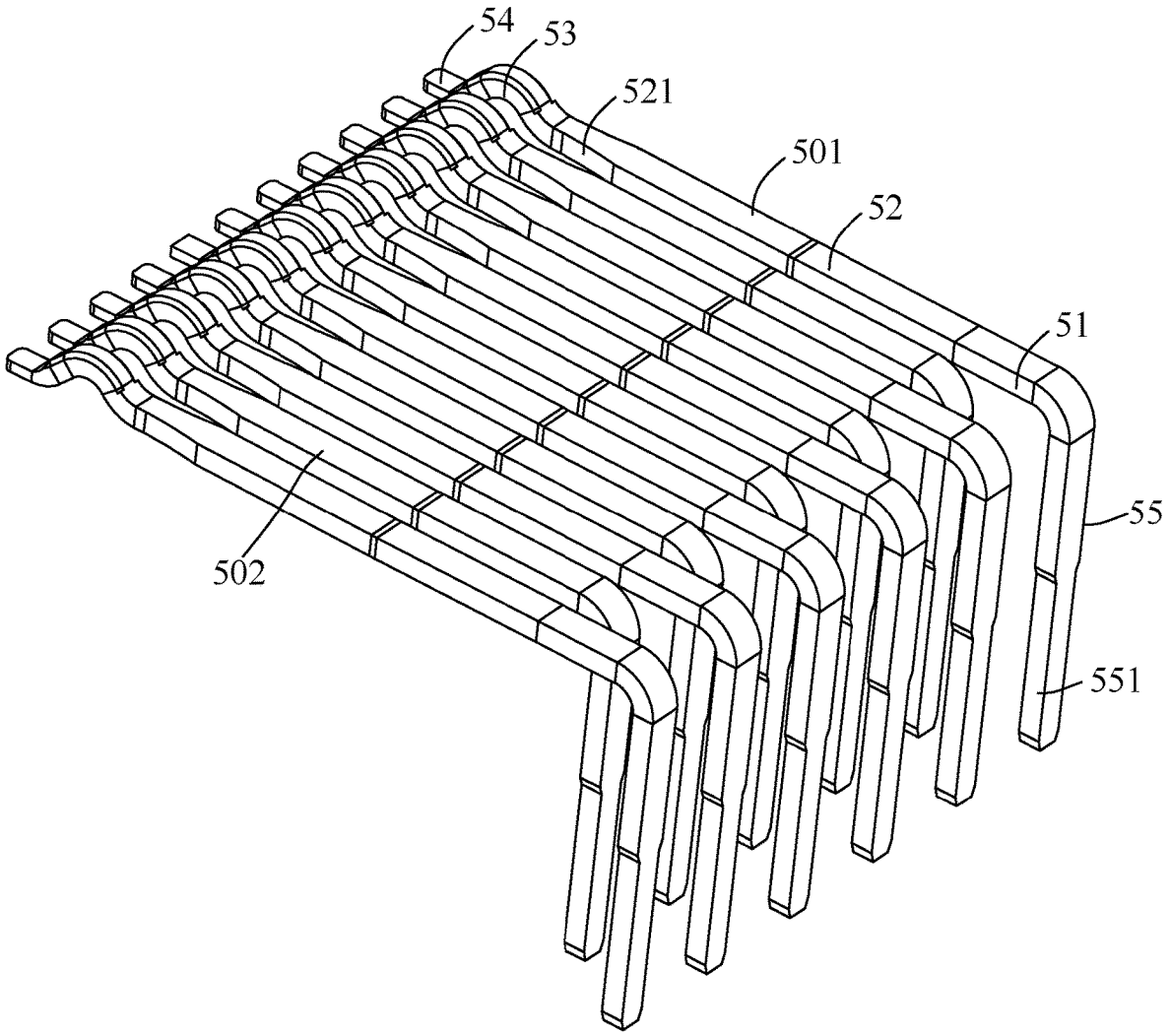
FIG. 5 is a perspective view of a plurality of connection terminals of the electrical connector in accordance with the present invention.
Figure 8:
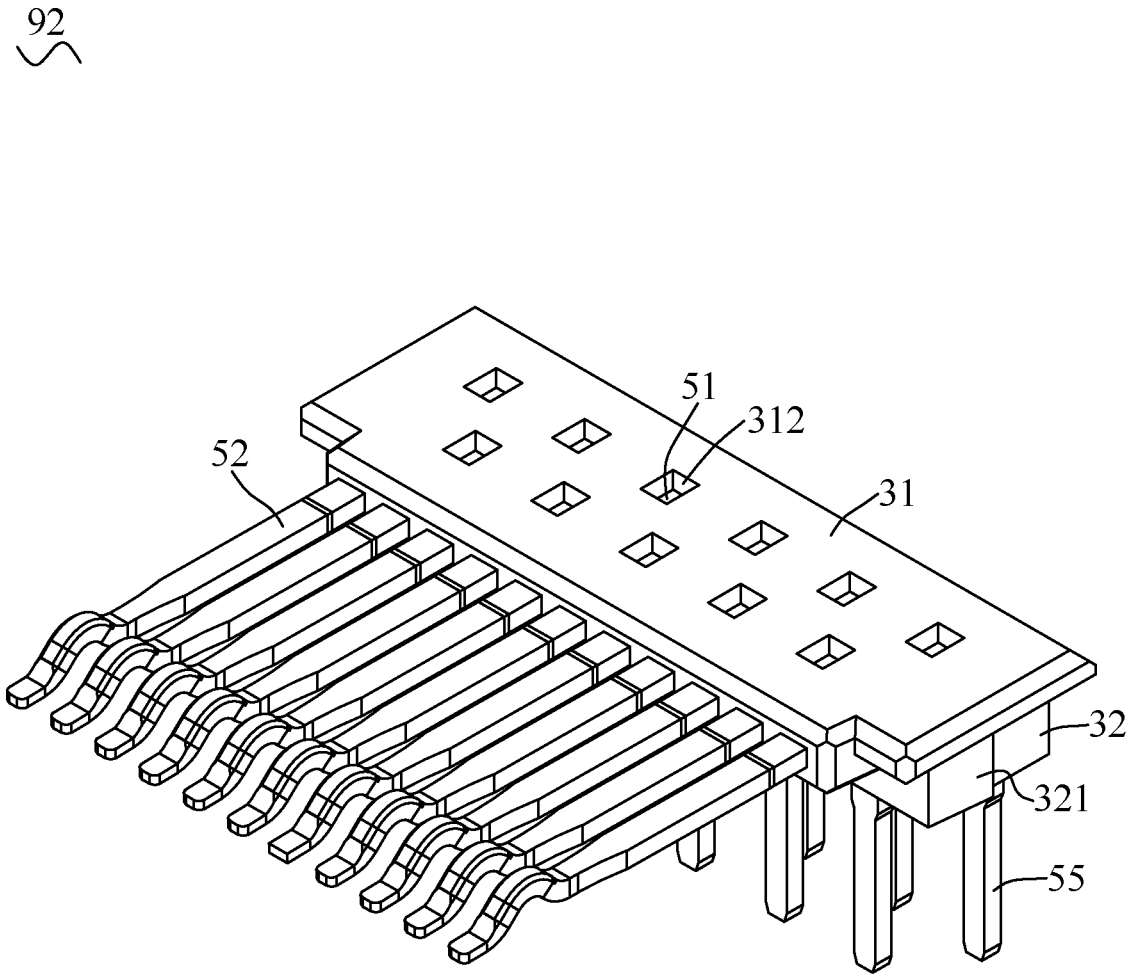
FIG. 8 is a perspective view of a connection terminal assembly of the electrical connector in accordance with the present invention.
Figure 9:
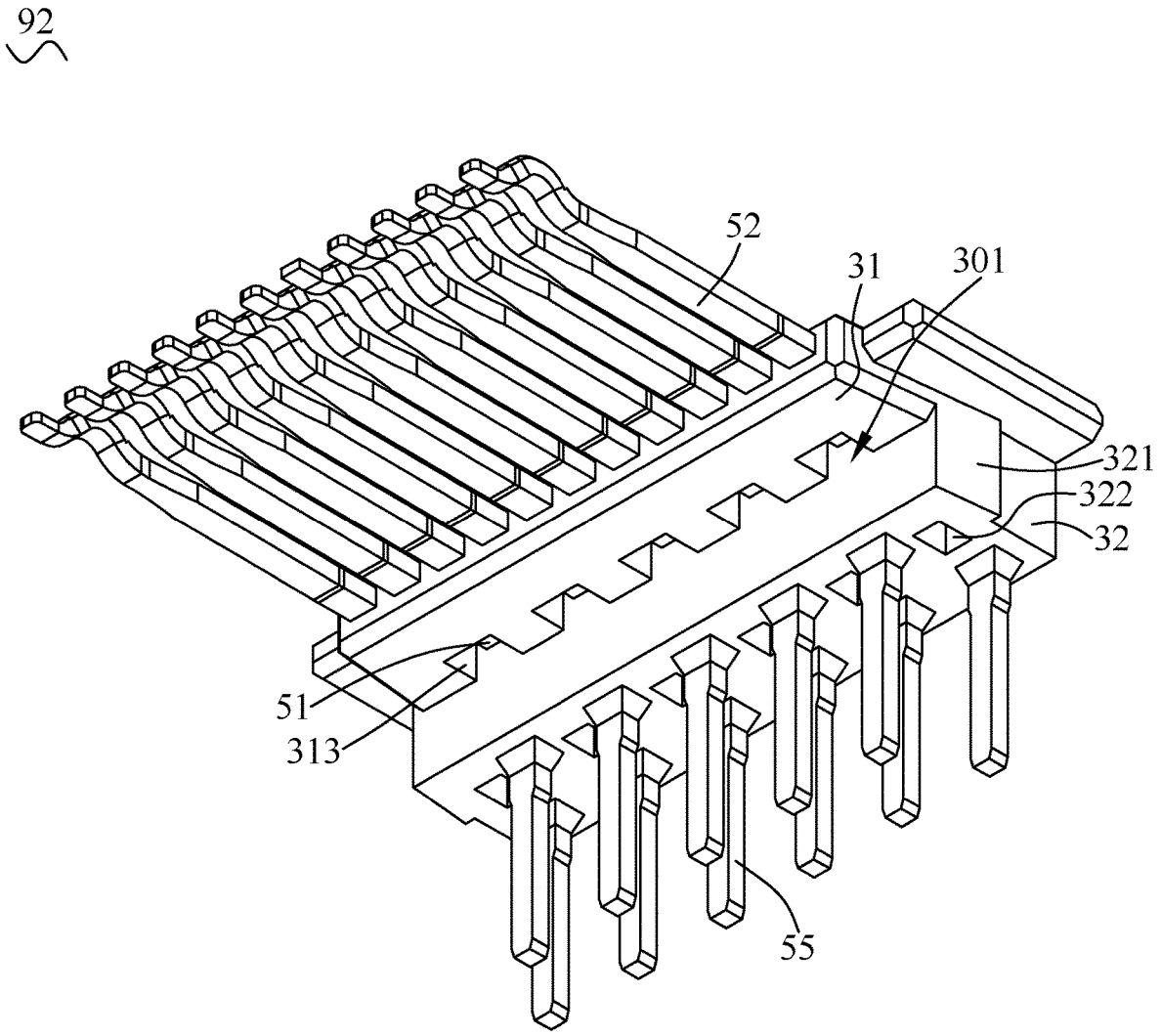
FIG. 9 is another perspective view of the connection terminal assembly of the electrical connector of FIG. 8.

With reference to FIG. 5, FIG. 8 and FIG. 9, the plurality of the connection terminals 5 are fixed in the plurality of the connection terminal grooves 33, respectively. Each connection terminal 5 has a second fixing portion 51. A front end of the second fixing portion 51 extends frontward to form a second extending portion 52. Two sides of a front end of the second extending portion 52 are gradually shrunk inward to show another trapezoid shape along the front-to-rear direction, and the front end of the second extending portion 52 is defined as a second material shrinking portion 521. A front end of the second material shrinking portion 521 is arched upward to form a second contact portion 53. A front end of the second contact portion 53 extends frontward to form a blocking portion 54. A rear end of the second fixing portion 51 extends downward to form a second vertical portion 55. Two opposite sides of a lower portion of the second vertical portion 55 are recessed inward. The lower portion of the second vertical portion 55 is defined as a second material reducing portion 551, and a width of the second material reducing portion 551 of the second vertical portion 55 is smaller than a width of the second fixing portion 51.

Figure 10:
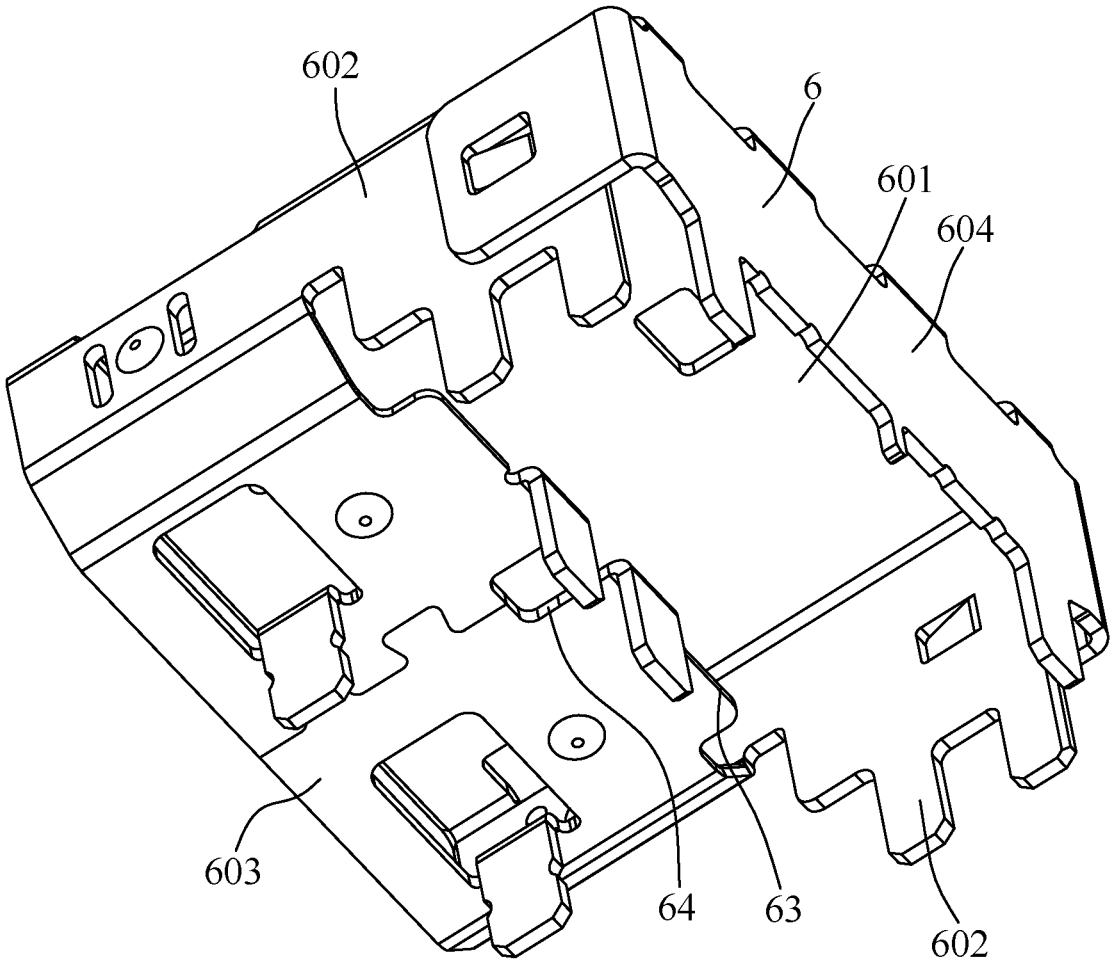
FIG. 10 is a perspective view of an outer shell of the electrical connector in accordance with the present invention.
Figure 11:
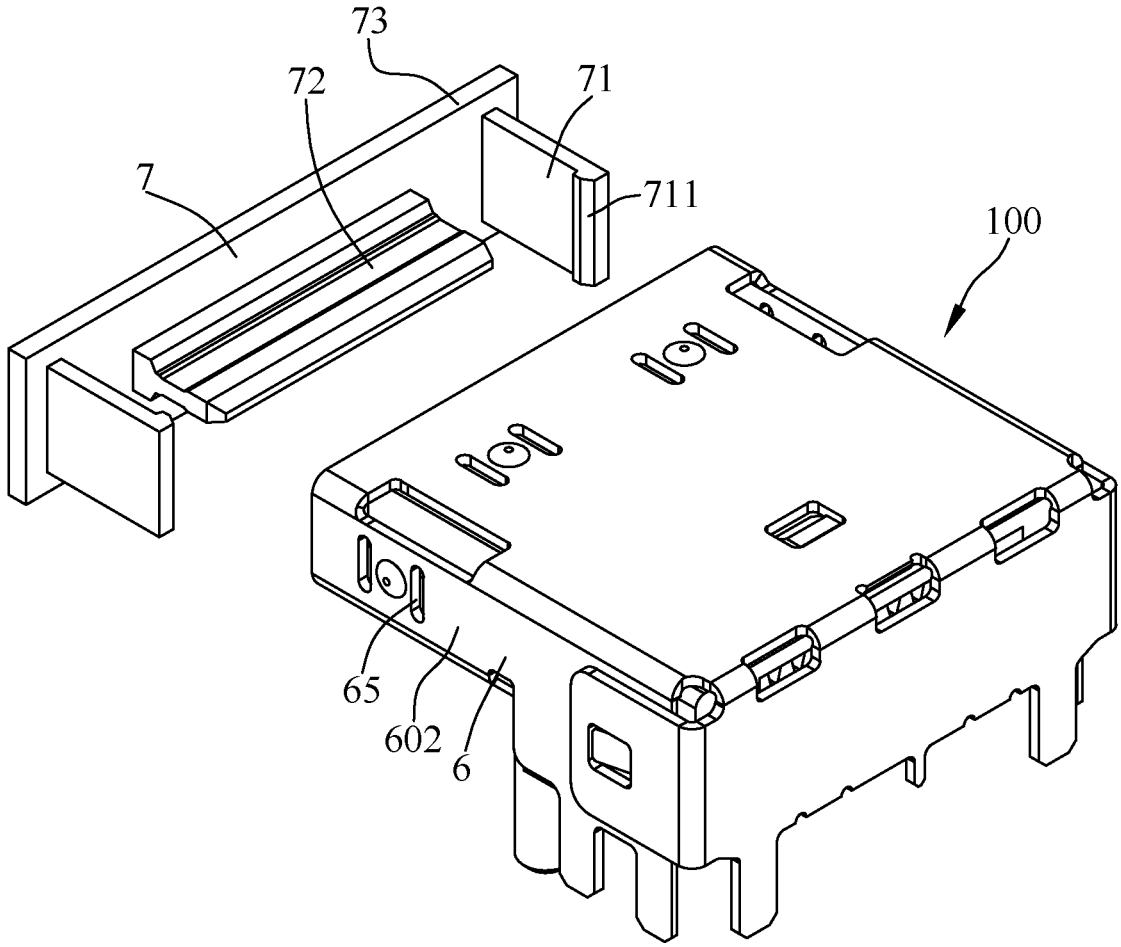
FIG. 11 is an exploded perspective view of a cover and the outer shell of the electrical connector in accordance with the present invention.
Figure 12:
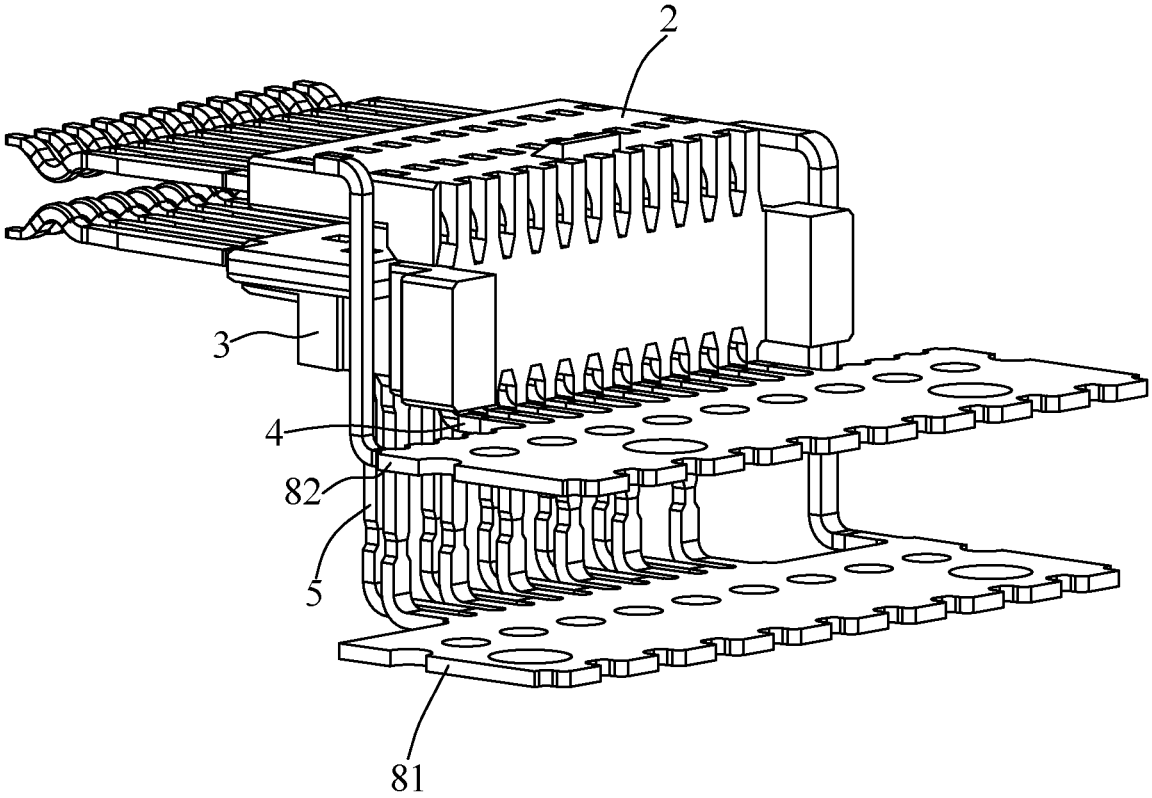
FIG. 12 is a perspective view of the conductive terminal assembly and the connection terminal assembly connected with a first material pulling element and a second material pulling element, respectively.

With reference to FIG. 2, FIG. 3 and FIG. 10, the outer shell 6 surrounds the insulating body 1. The outer shell 6 is of a hollow rectangular shape. The outer shell 6 has a top plate 601, two lateral plates 602 extended downward from two sides of the top plate 601, a rear plate 604 connected with the top plate 601 and the two lateral plates 602, and a bottom plate 603 connected with fronts of bottoms of the two lateral plates 602. A rear of the top plate 601 of the outer shell 6 opens a fixing hole 61. The bump 11 of the insulating body 1 is fixed in the fixing hole 61. A middle of the outer shell 6 has an accommodating space 62 penetrating through a front of the outer shell 6, and surrounded by the top plate 601, the two lateral plates 602 and the bottom plate 603. The insulating body 1 is accommodated in the accommodating space 62. A rear of a bottom of the outer shell 6 opens an accommodating groove 63 connected with a rear of a bottom of the accommodating space 62. A middle of a rear edge of the bottom plate 603 of the outer shell 6 is recessed frontward to form a limiting groove 64. The limiting block 12 of the insulating body 1 is limited in the limiting groove 64.

With reference to FIG. 1 to FIG. 12, when the electrical connector 100 is assembled, the plurality of the conductive terminals 4 are fixed in the plurality of the conductive terminal grooves 23, respectively. The plurality of the connection terminals 5 are fixed in the plurality of connection terminal grooves 33, respectively. The conductive terminal assembly 91 and the connection terminal assembly 92 are assembled to the insulating body 1. The first base body 2 is assembled in an upper portion of the receiving groove 14. The second base body 3 is assembled in a lower portion of the receiving groove 14. At the moment, the two buckling blocks 311 of the second base body 3 are buckled in the two buckling slots 161. The two fixing blocks 321 of the second base body 3 are blocked by the two abutting blocks 162 of the insulating body 1. The two stopping blocks 224 are locked in the two locking grooves 166, respectively. The base board 22 of the first base body 2 is located behind the second base body 3 and fixes the second base body 3 in the insulating body 1. The convex block 212 of the first base body 2 is fastened in the fastening groove 111 of the insulating body 1. The base board 22 of the first base body 2 and the embedding block 32 of the second base body 3 are exposed to the rear of the receiving groove 14. The rear of the receiving groove 14 is corresponding to the accommodating groove 63. The base board 22 of the first base body 2 and the embedding block 32 of the second base body 3 are exposed to the accommodating groove 63.

The buckling portions 44, the first contact portions 43 and front ends of the first extending portions 42 of the plurality of the conductive terminals 4 are assembled to the plurality of the front conductive terminal slots 151. Rear ends of the first extending portions 42 and the first fixing portions 41 of the plurality of the conductive terminals 4 together with the first base portion 21 are assembled to the rear conductive terminal slot 153. The first vertical portions 45 of the plurality of the conductive terminals 4 and the base board 22 are received in the rear of the receiving groove 14. The second contact portions 53, the blocking portions 54 and front ends of the second extending portions 52 of the plurality of the connection terminals 5 are assembled to the plurality of the front connection terminal slots 163. The second fixing portions 51 and rear ends of the second extending portions 52 of the plurality of the connection terminals 5 together with the second base portion 31 are assembled to the rear connection terminal slot 165. Upper portions of the second vertical portions 55 of the plurality of the connection terminals 5 and the embedding block 32 are received in the rear of the receiving groove 14 and located in front of the base board 22. Top surfaces of the first material reducing portions 421 of the plurality of the conductive terminals 4 are exposed upward in the plurality of the fifth openings 215 of the first base body 2, respectively. Bottom surfaces of the first material reducing portions 421 and the first fixing portions 41 of the plurality of the conductive terminals 4 are exposed downward to the first opening 213. Two sides of the first material reducing portion 421 of each conductive terminal 4 are exposed to one of the plurality of the second openings 214, respectively. Upper portions of the first vertical portions 45 of the plurality of the conductive terminals 4 are exposed to the plurality of the third openings 221. The material adding portions 223 of the first base body 2 cover rear surfaces of the lower portions of the first vertical portions 45 of the plurality of the conductive terminals 4. Front surfaces of the lower portions of the first vertical portions 45 of the plurality of the conductive terminals 4 are exposed to the plurality of the fourth openings 222. The first soldering portions 46 of the plurality of the conductive terminals 4 are exposed out of the insulating body 1.

The second fixing portions 51 of the plurality of the connection terminals 5 which include the second fixing portions 51 of the plurality of the first connection terminals 501 and the second connection terminals 502 are disposed corresponding to and exposed to the plurality of the exposing holes 301. A total length of the second fixing portion 51 and the second extending portion 52 of each first connection terminal 501 is longer than a total length of the second fixing portion 51 and the second extending portion 52 of each second connection terminal 502. Top surfaces of the second fixing portions 51 of the plurality of the connection terminals 5 are exposed upward in the plurality of the first exposing holes 312. Bottom surfaces of the second fixing portions 51 of the plurality of the second connection terminals 502 are exposed to the plurality of the second exposing holes 313. Bottom surfaces of the second fixing portions 51 of the plurality of the first connection terminals 501 are exposed to the plurality of the third exposing holes 322.

The electrical connector 100 is covered by an outer cover 7. The outer cover 7 has a blocking board 73. Two sides of a rear surface of the blocking board 73 protrude rearward to form two extending arms 71 parallel to each other. Free ends of inner surfaces of the two extending arms 71 protrude face to face to form two locking blocks 711, respectively. A middle of the rear surface of the blocking board 73 protrudes rearward to form a protruding portion 72 located between the two extending arms 71. The two lateral plates 602 of the outer shell 6 of the electrical connector 100 open two locking holes 65. The two locking holes 65 are corresponding to the two locking blocks 711 of the two extending arms 71. When the outer cover 7 is mounted to the electrical connector 100, the two locking blocks 711 are locked in the two locking holes 65 of the two lateral plates 602 of the outer shell 6. The protruding portion 72 is inserted into the insertion slot 13. The outer cover 7 prevents the insulating body 1 from being deformed by forces of the plurality of the conductive terminals 4 and the plurality of the connection terminals 5 when a finished product which includes the outer cover 7 and the electrical connector 100 is through a stove.

As described above, the first material reducing portions 421, the first material shrinking portions 422 and the lower portions of the first vertical portions 45 of the plurality of the conductive terminals 4 are disposed in the electrical connector 100, the top surfaces of the first material reducing portions 421 of the plurality of the conductive terminals 4 are exposed upward in the plurality of the fifth openings 215 of the first base body 2, respectively, the bottom surfaces of the first material reducing portions 421 and the first fixing portions 41 of the plurality of the conductive terminals 4 are exposed downward to the first opening 213, so positions and dimensions of the plurality of the conductive terminals 4 reach a best design in the conductive terminal assembly 91, and the upper portions of the first vertical portions 45 of the plurality of the conductive terminals 4 are exposed to the plurality of the third openings 221, so the electrical connector 100 and the conductive terminal assembly 91 achieve a high-frequency transmission effect. Furthermore, when the second base body 3 is molded, the second base portion 31 has the plurality of the second exposing holes 313 arranged transversely to limit the plurality of the connection terminals 5 in a mold, so the connection terminal assembly 92 has a better dimension accuracy. In addition, the plurality of the connection terminals 5 are connected with the first material pulling element 81, and the plurality of the conductive terminals 4 are connected with the second material pulling element 82 to reach conditions of manufacturing the electrical connector 100.

What is claimed is:

1. An electrical connector, comprising:

an insulating body, a middle portion of a front surface of the insulating body being recessed rearward to form an insertion slot, a middle portion of a rear surface of the insulating body being recessed forward to form a receiving groove penetrating downward through a bottom surface of the insulating body, a front of the receiving groove being divided into a rear conductive terminal slot and a rear connection terminal slot along an up-down direction, the insulating body opening a plurality of front conductive terminal slots penetrating through a front surface, a bottom surface and a rear surface of a top wall of the insertion slot, and a plurality of front connection terminal slots penetrating through a front surface, an upper surface and a rear surface of a bottom wall of the insertion slot, the rear conductive terminal slot being communicated among the plurality of the front conductive terminal slots, the insertion slot and a rear of the receiving groove, and the rear connection terminal slot being communicated among the plurality of the front connection terminal slots, the insertion slot and the rear of the receiving groove;

a conductive terminal assembly assembled to the insulating body, the conductive terminal assembly including a plurality of conductive terminals, and a first base body fastened to the plurality of the conductive terminals, the first base body having a plurality of openings, the first base body having a first base portion, a rear end of the first base portion protruding downward to form a base board, the first base body having a plurality of conductive terminal grooves transversely arranged in a row, the plurality of the conductive terminals being fixed in the plurality of the conductive terminal grooves, respectively, each conductive terminal having a first fixing portion, a front end of the first fixing portion extending frontward to form a first extending portion, two sides of a rear end of the first extending portion being recessed inward, the rear end of the first extending portion being defined as a first material reducing portion connected to the first fixing portion, so a width of the first material reducing portion being smaller than widths of the first fixing portion and the first extending portion, two sides of a front end of the first extending portion being gradually shrunk inward, and the front end of the first extending portion being defined as a first material shrinking portion, a front end of the material shrinking portion extending frontward and then being arched downward to form a first contact portion, a front end of the first contact portion being bent upward and then extending frontward to form a buckling portion, a rear end of the first fixing portion extending downward to form a first vertical portion, a width of a lower portion of the first vertical portion being smaller than widths of the first fixing portion and an upper portion of the first vertical portion, a bottom end of the first vertical portion being bent rearward to form a first soldering portion, a width of the first soldering portion being smaller than a width of the first vertical portion, the buckling portions, the first contact portions and front ends of the first extending portions of the plurality of the conductive terminals being assembled to the plurality of the front conductive terminal slots, rear ends of the first extending portions and the first fixing portions of the plurality of the conductive terminals together with the first base portion being assembled to the rear conductive terminal slot, the first fixing portions, the first material reducing portions and the first vertical portions of the plurality of the conductive terminals being exposed to the plurality of the openings, the first vertical portions of the plurality of the conductive terminals and the base board being received in the rear of the receiving groove, the first soldering portions of the plurality of the conductive terminals being exposed out of the insulating body;

a connection terminal assembly assembled to the insulating body, the connection terminal assembly including a plurality of connection terminals, and a second base body fastened to the plurality of the connection terminals, the second base body having a second base portion, a rear portion of a bottom surface of the second base portion extending downward to form an embedding block, the second base body having a plurality of connection terminal grooves, the plurality of the connection terminals being fixed in the plurality of the connection terminal grooves, respectively, each connection terminal having a second fixing portion, a front end of the second fixing portion extending frontward to form a second extending portion, a rear end of the second fixing portion extending downward to form a second vertical portion, front ends of the second extending portions of the plurality of the connection terminals being assembled to the plurality of the front connection terminal slots, the second fixing portions and rear ends of the second extending portions of the plurality of the connection terminals together with the second base portion being assembled to the rear connection terminal slot, upper portions of the second vertical portions of the plurality of the connection terminals and the embedding block being received in the rear of the receiving groove and located in front of the base board; and an outer shell surrounding the insulating body, a middle of the outer shell having an accommodating space penetrating through a front of the outer shell, the insulating body being accommodated in the accommodating space, a rear of a bottom of the outer shell opening an accommodating groove connected with a rear of a bottom of the accommodating space, the rear of the receiving groove being corresponding to the accommodating groove.

2. The electrical connector as claimed in claim 1, wherein several portions of a bottom surface of the base board protrude downward to form a plurality of material adding portions, and the plurality of the material adding portions are disposed corresponding to bottoms of the plurality of the conductive terminal grooves, the material adding portions cover rear surfaces of the lower portions of the first vertical portions of the plurality of the conductive terminals.

3. The electrical connector as claimed in claim 1, wherein a middle of a rear of a top surface of the insulating body protrudes upward to form a bump, the insulating body opens a fastening groove located at rear of the bump, a middle of a bottom surface of the insulating body protrudes downward to form a limiting block; a top surface of the first base portion protrudes upward to form a convex block, the convex block is fastened in the fastening groove, a rear of a top plate of the outer shell opens a fixing hole, the bump of the insulating body is fixed in the fixing hole, a middle of a rear edge of a bottom plate of the outer shell is recessed frontward to form a limiting groove, the limiting block of the insulating body is limited in the limiting groove.

4. The electrical connector as claimed in claim 1, wherein lower portions of two side walls of the receiving groove are recessed oppositely to form two buckling slots, the lower portions of the two side walls of the receiving groove protrude face to face to form two abutting blocks located under the two buckling slots, two sides of the second base portion protrude outward to form two buckling blocks, the two buckling blocks are buckled in the two buckling slots; fronts of two sides of the embedding block protrude outward to form two fixing blocks, respectively, the two fixing blocks are blocked by the two abutting blocks.

5. The electrical connector as claimed in claim 1, wherein bottoms of front ends of the plurality of the front conductive terminal slots are communicated with the insertion slot, an upper limiting board is disposed horizontally, and located between the front ends of the plurality of the front conductive terminal slots and the insertion slot.

6. The electrical connector as claimed in claim 1, wherein two sides of a front end of the second extending portion are gradually shrunk inward along a front-to-rear direction, and the front end of the second extending portion is defined as a second material shrinking portion, a front end of the second material shrinking portion is arched upward to form a second contact portion, a front end of the second contact portion extends frontward to form a blocking portion, two opposite sides of a lower portion of the second vertical portion are recessed inward, the lower portion of the second vertical portion is defined as a second material reducing portion, a width of the second material reducing portion of the second vertical portion is smaller than a width of the second fixing portion.

7. The electrical connector as claimed in claim 1, wherein tops of front ends of the plurality of the front connection terminal slots are communicated with the insertion slot, a lower limiting board is disposed horizontally, and located between the front ends of the plurality of the front connection terminal slots and the insertion slot.

8. The electrical connector as claimed in claim 1, wherein lower portions of two sides of the rear surface of the insulating body are recessed frontward to form two locking grooves, two sides of the base board protrude outward to form two stopping blocks, the two stopping blocks are locked in the two locking grooves, respectively.

9. The electrical connector as claimed in claim 1, wherein the plurality of the connection terminal grooves are of L shapes, mouths of the plurality of the L-shaped connection terminal grooves face downward, the plurality of the connection terminal grooves penetrate through a front surface of the second base portion and a bottom surface of the embedding block.

10. The electrical connector as claimed in claim 1, wherein the second base portion has a plurality of first exposing holes arranged in two rows, each row of the first exposing holes are arranged transversely, the plurality of the first exposing holes vertically penetrate upward through a top surface of the second base portion and connect with the plurality of the connection terminal grooves, respectively, the two rows of the first exposing holes are arranged in a staggered arrangement and along a front-to-rear direction, top surfaces of the second fixing portions of the plurality of the connection terminals are exposed upward in the plurality of the first exposing holes.

11. The electrical connector as claimed in claim 1, wherein the second base portion has a plurality of second exposing holes arranged transversely and disposed in front of the embedding block, the plurality of the second exposing holes vertically penetrate downward through a bottom surface of the second base portion and connect with the plurality of the connection terminal grooves, respectively, the embedding block has a plurality of third exposing holes penetrating downward through a bottom surface of the embedding block, the plurality of the third exposing holes extend upward and connect with the plurality of the connection terminal grooves, respectively, the plurality of the third exposing holes are interposed to areas among the plurality of the connection terminal grooves, the plurality of the connection terminals include a plurality of first connection terminals and a plurality of second connection terminals, bottom surfaces of the second fixing portions of the plurality of the second connection terminals are exposed to the plurality of the second exposing holes, bottom surfaces of the second fixing portions of the plurality of the first connection terminals are exposed to the plurality of the third exposing holes.

12. The electrical connector as claimed in claim 1, wherein the electrical connector is covered by an outer cover, the outer cover has a blocking board, two sides of a rear surface of the blocking board protrude rearward to form two extending arms parallel to each other, free ends of inner surfaces of the two extending arms protrude face to face to form two locking blocks, respectively, a middle of the rear surface of the blocking board protrudes rearward to form a protruding portion located between the two extending arms, two lateral plates of the outer shell of the electrical connector open two locking hole, the two locking blocks are locked in the two locking holes of the two lateral plates of the outer shell, the protruding portion is inserted into the insertion slot.

13. The electrical connector as claimed in claim 1, wherein the plurality of the openings include a first opening, a plurality of the second openings, a plurality of third openings, a plurality of fourth openings and a plurality of the fifth openings.

14. The electrical connector as claimed in claim 13, wherein a rear of a bottom surface of the first base portion is recessed upward to bottoms of front ends of the plurality of the conductive terminal grooves to form the first opening, a top wall of the first opening has the plurality of the second openings penetrating through side walls of the plurality of the conductive terminal grooves and extending to top walls of the plurality of the conductive terminal grooves, bottom surfaces of the first material reducing portions and the first fixing portions of the plurality of the conductive terminals are exposed downward to the first opening, two sides of the first material reducing portion of each conductive terminal are exposed to one of the plurality of the second openings, respectively.

15. The electrical connector as claimed in claim 13, wherein the first base body opens the plurality of the third openings arranged transversely, the plurality of the third openings penetrate through a top end of a rear surface and a rear end of a top surface of the base board, and extend to tops of rear ends of the plurality of the conductive terminal grooves, the base board opens the plurality of the fourth openings arranged transversely, the plurality of the fourth openings penetrate a lower portion of a front surface and a front of a bottom surface of the base board, and extend rearward to fronts of lower portions of the plurality of the conductive terminal grooves, upper portions of the first vertical portions of the plurality of the conductive terminals are exposed to the plurality of the third openings, front surfaces of lower portions of the first vertical portions of the plurality of the conductive terminals are exposed to the plurality of the fourth openings.

16. The electrical connector as claimed in claim 13, wherein the first base portion has the plurality of the fifth openings penetrating through a top surface of the first base portion and communicating with tops of front ends of the conductive terminal grooves, top surfaces of the first material reducing portions of the plurality of the conductive terminals are exposed upward in the plurality of the fifth openings, respectively.

17. A terminal assembly of an electrical connector, comprising:

a plurality of conductive terminals, each conductive terminal having a first fixing portion, a front end of the first fixing portion extending frontward to form a first extending portion, two sides of a rear end of the first extending portion being recessed inward, the rear end of the first extending portion being defined as a first material reducing portion connected to the first fixing portion, so a width of the first material reducing portion being smaller than widths of the first fixing portion and the first extending portion, two sides of a front end of the first extending portion being gradually shrunk inward to show a trapezoid shape along a front-to-rear direction, and the front end of the first extending portion being defined as a first material shrinking portion, a front end of the first material shrinking portion extending frontward and then being arched downward to form a first contact portion, a front end of the first contact portion being bent upward and then extending frontward to form a buckling portion, a rear end of the first fixing portion extending downward to form a first vertical portion, a width of a lower portion of the first vertical portion being smaller than widths of the first fixing portion and an upper portion of the first vertical portion, a bottom end of the first vertical portion being bent rearward to form a first soldering portion, a width of the first soldering portion being smaller than a width of the first vertical portion; and a base body integrally molded to the plurality of the conductive terminals, the base body having a first base portion disposed horizontally, a rear end of the base portion protruding downward to form a base board, the base body having a plurality of conductive terminal grooves transversely arranged in a row, the row of the conductive terminal grooves penetrating through a front surface of the first base portion and a bottom surface of the base board, the plurality of the conductive terminals being fixed in the plurality of the conductive terminal grooves, respectively, the first base body having a plurality of openings communicated with the plurality of the conductive terminal grooves, the first fixing portions, the first material reducing portions and the first vertical portions of the plurality of the conductive terminals being exposed to the plurality of the openings, the first soldering portions of the plurality of the conductive terminals being exposed out of the insulating body.

18. The terminal assembly as claimed in claim 17, wherein several portions of a bottom surface of the base board protrude downward to form a plurality of material adding portions, and the plurality of the material adding portions are disposed corresponding to bottoms of the plurality of the conductive terminal grooves, the material adding portions cover rear surfaces of the lower portions of the first vertical portions of the plurality of the conductive terminals.

19. The terminal assembly as claimed in claim 17, wherein the plurality of the openings include a first opening, a plurality of the second openings, a plurality of third openings, a plurality of fourth openings and a plurality of the fifth openings, a rear of a bottom surface of the first base portion is recessed upward to bottoms of front ends of the plurality of the conductive terminal grooves to form the first opening, a top wall of the first opening has the plurality of the second openings penetrating through side walls of the plurality of the conductive terminal grooves and extending to top walls of the plurality of the conductive terminal grooves, bottom surfaces of the first material reducing portions and the first fixing portions of the plurality of the conductive terminals are exposed downward to the first opening, two sides of the first material reducing portion of each conductive terminal are exposed to one of the plurality of the second openings, respectively, the first base body opens the plurality of the third openings arranged transversely, the plurality of the third openings penetrate through a top end of a rear surface and a rear end of a top surface of the base board, and extend to tops of rear ends of the plurality of the conductive terminal grooves, the base board opens the plurality of the fourth openings arranged transversely, the plurality of the fourth openings penetrate a lower portion of a front surface and a front of a bottom surface of the base board, and extend rearward to fronts of lower portions of the plurality of the conductive terminal grooves, upper portions of the first vertical portions of the plurality of the conductive terminals are exposed to the plurality of the third openings, front surfaces of lower portions of the first vertical portions of the plurality of the conductive terminals are exposed to the plurality of the fourth openings, the first base portion has a plurality of fifth openings penetrating through a top surface of the first base portion and communicating with tops of front ends of the conductive terminal grooves, top surfaces of the first material reducing portions of the plurality of the conductive terminals are exposed upward in the plurality of the fifth openings, respectively.

20. A terminal assembly of an electrical connector, comprising:

a plurality of connection terminals, each connection terminal having a second fixing portion, a front end of the second fixing portion extending frontward to form a second extending portion, two sides of a front end of the second extending portion being gradually shrunk inward to show a trapezoid shape along a front-to-rear direction, and the front end of the second extending portion being defined as a second material shrinking portion, a front end of the second material shrinking portion being arched upward to form a second contact portion, a front end of the second contact portion extending frontward to form a blocking portion, a rear end of the second fixing portion extending downward to form a second vertical portion, two opposite sides of a lower portion of the second vertical portion being recessed inward, the lower portion of the second vertical portion being defined as a second material reducing portion, and a width of the second material reducing portion of the second vertical portion being smaller than a width of the second fixing portion; and a second base body integrally molded to the plurality of the connection terminals, the second base body having a second base portion, a rear portion of a bottom surface of the second base portion extending downward to form an embedding block, the second base body having a plurality of connection terminal grooves, the plurality of the connection terminal grooves being of L shapes, mouths of the plurality of the L-shaped connection terminal grooves facing downward, the plurality of the connection terminal grooves penetrating through a front surface of the second base portion and a bottom surface of the embedding block, the second base body having a plurality of exposing holes communicated with the plurality of the connection terminal grooves, the plurality of the connection terminals being fixed in the plurality of the connection terminal grooves, respectively, the second fixing portions of the plurality of the connection terminals being disposed corresponding to and exposed to the plurality of the exposing holes.

* * * * *